US007213418B2

(12) United States Patent
Maxa et al.

(10) Patent No.: US 7,213,418 B2
(45) Date of Patent: May 8, 2007

(54) METHOD OF PRODUCING HOSE-LIKE KNITWEAR

(75) Inventors: Jaroslav Maxa, Trebic (CZ); Petr Maxa, Trebic (CZ); Petr Machovec, Trebic (CZ); Miroslav Kopecny, Trebic (CZ)

(73) Assignee: Uniplet Trebic, A.S., Trebic (CZ)

( * ) Notice: Subject to any disclaimer, the term of this patent is extended or adjusted under 35 U.S.C. 154(b) by 525 days.

(21) Appl. No.: 10/679,590

(22) Filed: Oct. 6, 2003

(65) Prior Publication Data

US 2006/0174660 A1 Aug. 10, 2006

(30) Foreign Application Priority Data

Oct. 17, 2002 (CS) ..... PV3450-02

(51) Int. Cl.
*D04B 9/40* (2006.01)

(52) U.S. Cl. ..... 66/148

(58) Field of Classification Search ..... 66/148, 66/147, 95

See application file for complete search history.

(56) References Cited

U.S. PATENT DOCUMENTS 855,122 A 5/1907 McElvaney
1,188,125 A * 6/1916 Williams ..... 66/148
3,609,998 A 10/1971 Mutze et al.
3,800,563 A * 4/1974 Billi ..... 66/95
4,014,186 A * 3/1977 Ferraguti ..... 66/95
5,727,400 A 3/1998 Lonati et al.
5,761,931 A 6/1998 Lonati et al.
5,816,075 A 10/1998 Lonati et al.
5,907,960 A 6/1999 Lonati et al.
6,176,106 B1 1/2001 Lonati et al.
6,223,564 B1 5/2001 Lonati et al.
6,591,637 B2 * 7/2003 Jurgens ..... 66/148

FOREIGN PATENT DOCUMENTS

EP 0 838 544 10/1997

* cited by examiner

*Primary Examiner*—Danny Worrell
(74) *Attorney, Agent, or Firm*—Notaro & Michalos P.C

(57) ABSTRACT

One-cylinder circular knitting machine for production of hose-like knitwear, such as socks, etc., that are closed at one of their ends, is provided with an dial plate (3) situated above the needle cylinder of the machine and equipped with dial sinkers (4, 4') for cooperation with needles (1) during transferring the knitting. The machine is provided with a device for transferring the retained knitting of the toe pouch (V) knitted on a half-circle of needles (1) from one half of the dial sinkers (4) to the other half of the dial sinkers (4').

5 Claims, 2 Drawing Sheets

METHOD OF PRODUCING HOSE-LIKE KNITWEAR

FIELD OF THE INVENTION

The present invention relates to a method of producing hose-like knitwear, such as socks, which is closed at one end, using a one-cylinder circular knitting machine provided with an dial plate situated above a needle cylinder. The dial plate is equipped with dial sinkers which are arranged to operate cooperatively with needles during the make-up and transfer of the knitwear.

BACKGROUND OF THE INVENTION

Small-diameter one-cylinder circular knitting machines used in the production of hosiery or similar goods and equipped with a device used to close the toes directly in the machine by means of an overturnable half-plate which is situated above the needle cylinder of the machine, are known. This half-plate is equipped with transferring sinkers of special forms. The transferring sinkers have controlling butts on both sides, which are controllable in both of their positions, for receiving and handing over of knitting loops in forming the closed toe, and for the hanging up of a double welt in the basic non-overturned position. The transferring sinkers cooperate gradually in the knitting of a closed toe with both half-circles of needles: first, with the first half of the needles, or the so called heel needles, during the make-up of the loops before the formation of a toe pouch by means of a reciprocation run of the needle cylinders, and second, during the transfer of the retained knitting to the needles (i.e., instep needles) of the second half-circle after overturning the half-plate in closing the knitting of the toe. The transferring dial sinkers of the half-plate are of a very filigree workmanship which require accuracy and precision in mounting and control to accomplish a properly executed transfer of the loops from the heel arch to the instep arch. However, in the knitting of the double welt, for example, this device works as an integral part of the dial, and so in fact, it limits the function or the possibilities of the dial plate, particularly with regard to the limited workmanship and arrangement possibilities of the half-plate cams with regard to the built up space.

Another disadvantage consists in that during the overturning of the half-plate, the loops that are overturned only at the distance of one needle (i.e., the loops on the ends of the knitting arc) cause holes in the knitting at the knitwear toe, and consequently, produce a knitted product that is of poor quality. This is because the end loops are the most stretched ones during the overturning process.

Accordingly, it is an object of this invention to provide a novel method and apparatus for producing a high-quality toe closing directly in the machine without limiting the dial function.

SUMMARY OF THE INVENTION

The invention is characterized in that, first, the make-up of the toe knitting on the first half-circle of needles and the first half of the dial sinkers, corresponding to the heel part of the knitwear, is carried out. Thereafter, the toe pouch is knitted in reverse run on the first half-circle of needles. The part of the knitwear, which is retained on the dial sinkers and having been knitted on the first half-circle of needles, is transferred onto the transferring means, and then subseqently transferred towards the second half of the dial sinkers.

The transferred part of the knitwear is transferred to the second half of the dial sinkers, and from the second half of the dial sinkers, it is then transferred to the corresponding needles of the second half-circle. Further, it is preferable if the part of the knitwear retained on the first part of the dial sinkers is taken off the first part of the dial sinkers by a transferring means and overturned 180° by the transferring means toward the second half of the dial sinkers. The part of the knitwear retained on the transferring means is then transferred by the second half of the dial sinkers to the needles of the second half-circle.

It is another advantage that by retracting the first half of the dial sinkers with loops of the retained knitwear part towards a smaller diameters, the loops are taken off and hanged on the working ends of the transferring means. After overturning the transferring means by 180° by and radially extending outward the second half of the corresponding retracted dial sinkers by a predetermined distance, the loops of the overturned part of the knitting are taken off the working ends of the transferring means and placed above the needles of the second half-circle, which then lift upward and engage the loops.

Further, a one-cylinder circular knitting machine according to this invention for producing hose-like knitwear, such as socks, that is closed at one ends is provided with an dial plate situated above the needle cylinder of the machine. The dial plate is equipped with dial sinkers for cooperation with needles during the transferring operation of the knitting. The machine is further characterized in that it is provided with a device for transferring the retained knitting of the toe pouch knitted on a half-circle of needles from one half of the dial sinkers to the other half of the dial sinkers.

It is an advantage that the device for transferring of the retained knitwear from one half of the dial sinkers to the other half of the dial sinkers is comprised of two half-circle plates arranged in a side by side relationship and attached controllably and swingingly to the dial plate with a 180° swing about a transverse axis. The half circle plates have circular ends with adjacently positioned transferring sinkers angularly situated so that they reach in between the dial sinkers.

It is another advantage that the first transferring sinkers situated on one half-circle plate are, on their working ends, provided with hook-like ends with recesses and oblique edges for transferring knitting loops. The other transferring sinkers are provided with rounded edges, which are situated opposite the recesses and oblique edges of the first transferring sinkers.

BRIEF DESCRIPTION OF THE DRAWINGS

The method and machine according to the invention are shown in drawings, in which.

DETAILED DESCRIPTION OF THE INVENTION

Figure 1:
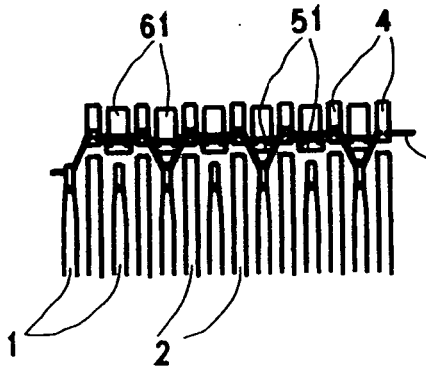
FIG. 1 is showing schematically an outside view of the position of the needles, dial sinkers, transferring sinkers, cast-off sinkers as well as the yarn position at the make-up stage.

A known one-cylinder circular knitting machine for producing hosiery goods is provided with needles 1 (FIG. 1), which are operatively mounted in the needle cylinder, and cast-off sinkers 2, which are operatively mounted in the sinker cap. Further, the machine is provided with a known dial plate 3 (FIG. 2) mounted coaxially above the needle cylinder. Apart from a cutting saw and a holding device, the dial sinkers 4 are slidably arranged in the radial grooves of the dial plate 3. Dial sinkers 4 are arranged on one half of the circumference of the dial plate 3, i.e., the half which corresponds to the heel needles 1, and dial sinkers 4' (FIG. 3) are arranged on the other half of the dial plate 3. Both dial sinkers 4, 4' are arranged in cooperation with the needles 1 for, e.g., retaining the knitting when the double welt of the knitwear is knitted, and their arrangement and number corresponds to the cast-off sinkers 2.

According to the invention, the machine is provided with a device for transferring the half-circle part of the reciprocally knitted toe pouch of the knitwear, which is retained on dial sinkers 4, to dial sinkers 4' for the purpose of closing the toe portion.

The two half-circle plates 5, 6 are arranged in a side by side relationship on the bottom side of the dial plate 3 and are controllably and swingably mounted for 180° pivotal movement about a transverse axis. The movement of each of the half-circle plates is effected by means of its geared wheel 7 and geared rod 8 engaging and operatively cooperating with each other, whereby, the geared rods 8 are controlled by pneumatic pistons. The first transferring sinkers 51 are mounted on the circular edge of the first plate 5 and are angularly situated so that they reach in between either dial sinkers 4 or 4', depending on which half of the dial plate the half-circle plates are placed. On the circular end of the other plate 6, the other transferring sinkers 61 are mounted, which also reach in between dial sinkers 4 or 4'.

Figure 7:
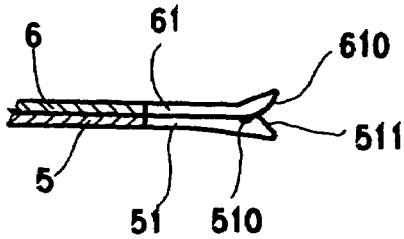
FIG. 7 shows an embodiment of the transferring sinkers in the closed position.

The first transferring sinkers 51 are adjacent the second transferring sinkers 61. In a basic position, both half-circle plates 5, 6 and, therefore, also the first and second transferring sinkers 51, 61 are slightly angularly separated in a very sharp angle so that there is a gap between them for the passage of the loops of the transferred stitches. This position is secured by various stops (not shown) of the half-circular plates 5, 6, which are arranged at the bottom of the dial plate 3. The cooperating ends of the adjacent transferring sinkers 51, 61 are adapted for mutual cooperation. On the first transferring sinkers 51, there is provided hook-like working ends with recesses 510 (FIG. 7) and oblique edges 511 formed at the front of first transferring sinkers 51 for the transfer of said loops. The working ends of the other transferring sinkers 61 have rounded edges 610 for throwing off said loops, and the edges 610 are situated opposite the recesses 510 and oblique edges 511 of the first transferring sinkers 51. All said transferring sinkers 51, 61 in the basic position are arranged at the height level of the dial sinkers 4, and the radius at which their working ends are situated is shorter then the radius where the stitch loops of the transferred knitting are resting on dial sinkers 4 during making-up of the thread at the beginning of the knitting of the toe pouch, but longer than the radius where the hooks of the fully retracted dial sinkers 4 or 4' are situated.

Function of the above described apparatus is as follows: A sock is knitted from the toe to the welt. Initially, the make-up of the knitting is performed during reciprocation of the machine on the first half-circle, i.e., on the needles 1 and the dial sinkers 4 that correspond to the heel or the sole part of the knitwear.

Figure 2:
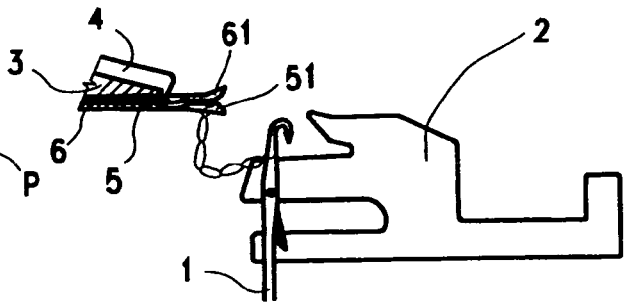
FIG. 2 is showing schematically a hang up of the toe knitting beginning on the transferring sinkers after knitting the initial courses with the needles of the first half-circle.
Figure 3:
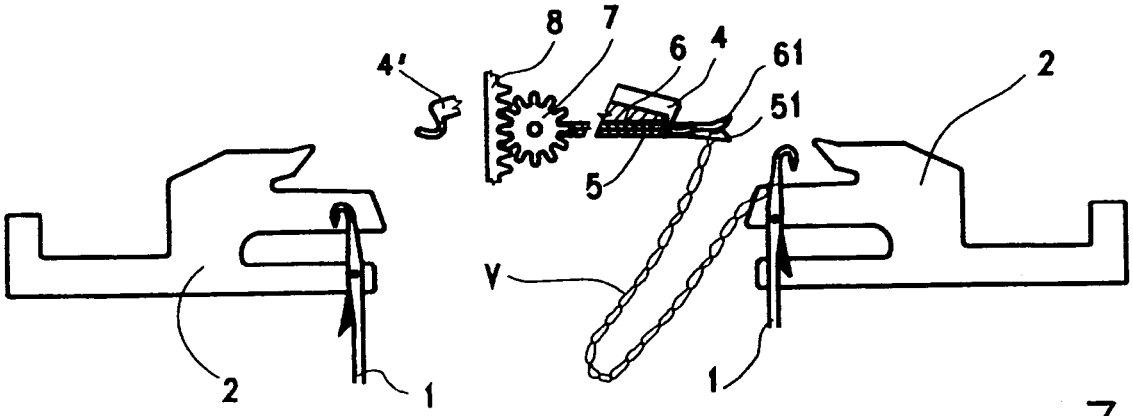
FIG. 3 is showing schematically the position of the needles and dial sinkers of both half-circles and the transferring device after the toe pouch knitting has been finished, but prior to the overturning step.

First, during rotation of the needle cylinder in the direction of the rotational knitting, the thread P is engaged by even needles 1, as shown in FIG. 1, and by the odd needles 1 after the reversal of the rotation direction. After a partial retraction of dial sinkers 4 and knitting of several reverse courses under narrowing of stitches, while the knitting is retained on dial sinkers 4, dial sinkers 4 are fully retracted to the most distant position, as shown in FIG. 2.

During the process of retracting dial sinkers 4, the loops of the retained thread P are carried by the hooks of dial sinkers 4 in a direction towards the centre (e.g., of the dial plate) and, thereby, during the movement of the hooks, to a radius smaller than the radius formed by recesses 510. The loops of the retained thread P slide along the oblique edges 511 of the transferring sinkers 51 till the loops finally fit into the recesses 510, and are held by the transferring sinkers 51.

Then, the process is continued with the reciprocal knitting of the toe pouch V under the narrowing and then adding of the needles 1. After the toe pouch V on the first half-circle of needles 1 has been finished, by a synchronised movement of pneumatic pistons and by means of the geared wheels 7 and the geared rods 8, the half-circle plate 6 first swings from the basic position downwards so that the recesses 510 are closed by rounded edges 610, so that the toe pouch V cannot fall off the transferring sinkers 51 and 61 in the subseqent production steps (see FIG. 3).

Figure 4:
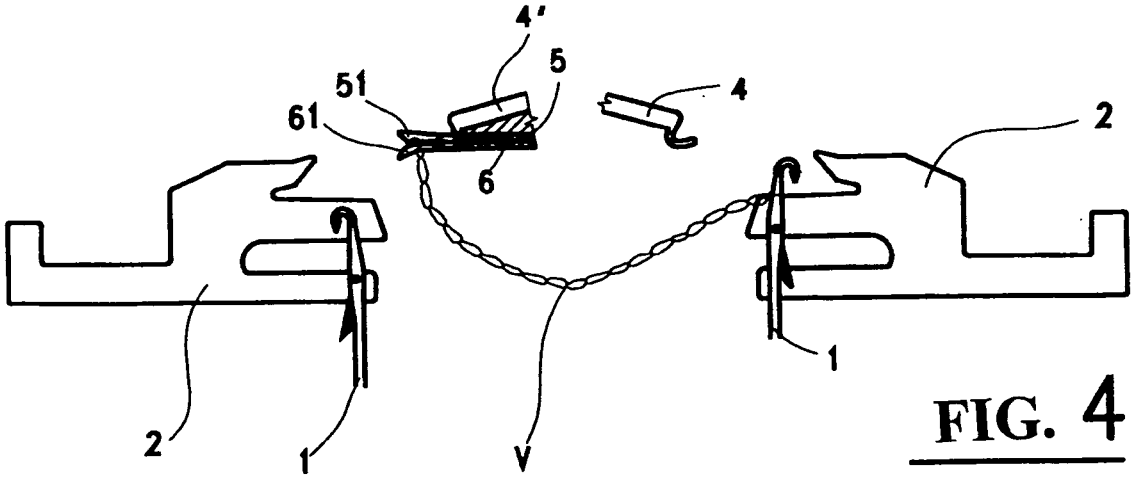
FIG. 4 shows the same as FIG. 3, but after the transferring sinkers have been overturned.

The half-circle plate 5 then swings from the basic position and subsequently both plates are simultaneously overturned by 180°, e.g., in a clockwise direction, so that their transferring sinkers 51 and 61 get to the same height level as dial sinkers 4' on the other half of the dial plate 3. Dial sinkers 4' are fully retracted, so that the tips of the transferring sinkers 51 and 61 are at a greater radial length (see FIG. 4). The half-circle plate 6 abuts on a stopper (not shown) so that again, as in the basic position before the overturning step, both half-circle plates 5 and 6 are deflected to an open state As a result, recesses 510 are no longer closed by the rounded edges 610 on which, after the step of overturning, the loops of the overturned knitting of the toe pouch V now hang . By the above described overturning operation of the transferring sinkers 51 and 61, the retained edge of the toe pouch V is now situated on the other half of the dial plate 3, i.e., the half with dial sinkers 4' or the instep side of the knitwear.

Figure 5:
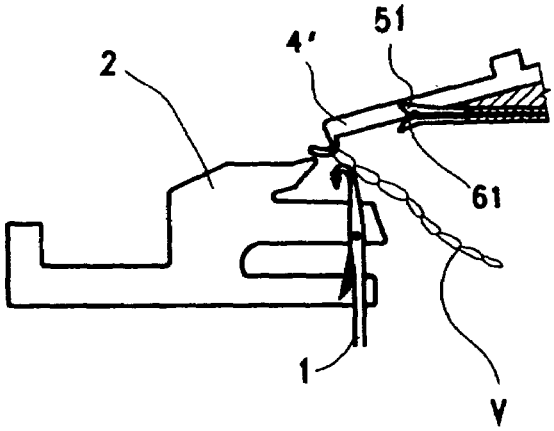
FIG. 5 is showing schematically the position of the needles and dial sinkers of the other half-circle and the taken out transferring sinkers after taking the toe knitwear off the transferring sinkers, but before transferring the transferred portion of the toe knitwear to the needles of the second half-circle.
Figure 6:
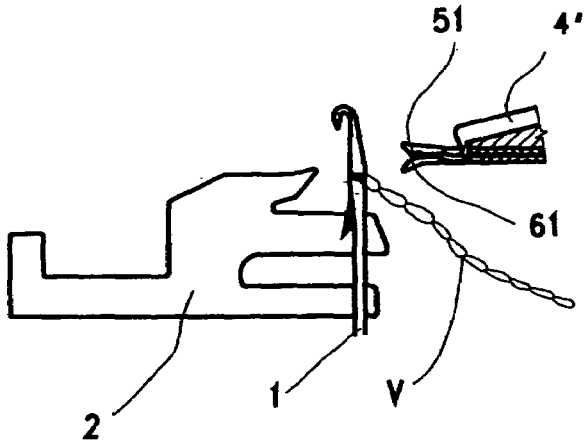
FIG. 6 shows the same as FIG. 5, but after the transfer of the transferred portion of the toe knitwear to the needles of the second half-circle.

The up to now retracted dial sinkers 4' are then extended outward, and, from the transferring sinkers 51 and 61, dial sinkers 4' take or engage the corresponding half-circle of the heel pouch V (see FIG. 5). Preferably, the hooks of the dial sinkers 4' is inserted into the loops of the knitting, and, by their vertical edges and while moving away from the centre of the dial plate 3, dial sinkers 4' take the loops off the rounded edges 610. Then, the corresponding needles 1 of the second half-circle, which up to now has not been used for knitting, lift and take the edge or loops of the overturned knitting of the toe pouch V from the now again receding dial sinkers 4'.The toe knitting is closed by this production step and knitting is now placed on all needles 1 (see FIG. 6).

In the next processing, the sole, instep, heel, calf, and the welt terminated by a course which does not unravel, are knitted by a common method.

Within the scope of the invention, the circular knitting machine can be used particularly for the production of hosiery with closed toe, but can also be used for the production of any hose-like products that are closed at one end.

Within the scope of the invention, it is possible to make various modifications and changes of the circular knitting machine without departing from the scope of the claims. At the same time all parts can be substituted by their technical equivalents.

The invention claimed is:

1. A method of producing a hose-like knitted product which is closed at one end using a one-cylinder circular knitting machine provided with a dial plate that is situated above a needle cylinder, the dial plate being equipped with dial sinkers in operative arrangement with a plurality of needles of the circular knitting machine, the plurality of needles being divided into a first half-circle of needles and a second half-circle of needles, a first half of dial sinkers (4) being located on one side of the dial plate corresponding to the first half-circle of needles and a second half of dial sinkers (4') being located on the other side of the dial plate corresponding to the second half-circle of needles, wherein the method comprises the steps of:

performing make-up of knitting loops defining a toe portion of the knitted product on the first half-circle of needles and the first half of dial sinkers (4)

knitting a number of courses in reverse run with the first half-circle of needles to form a toe pouch (V) with the knitting loops on one edge of the toe pouch (V) being retained on the first half of dial sinkers (4);

retracting the first half of dial sinkers (4) inward to transfer the knitting loops on the retained edge to corresponding loop retaining ends on transferring means (5,6,51,61) with the loop retaining ends pointing toward the first half-circle of needles radially in a semi-circular pattern and the transferring means in operative arrangement with the first half dial sinkers (4), the transfer means being pivotable about a transverse axis;

overturning the transferring means about the pivotal axis thereof such that the loon retaining ends are pointing toward the second half-circle of needles and the transferring means is in operative engagement with the second half of dial sinkers (4')

extending the second half of dial sinkers (4') outward to engage and carry the knitted loops of the retained edge to a position over the respective ones of the second half-circle of needles;

actuating the second half-circle of needles to engage the respective knitted loops of the retained edge: and continue knitting from the edges of the toe pouch simultaneously with at least one of the first half-circle of needles and the first half-circle of needles to form the knitted product.

2. A method of claim 1, wherein the knitted loops of the retained edge disposed on the first half of dial sinkers (4) are taken off the dial sinkers (4) by the transferring means (5,6,51,61) wherein the transferring means is overturned 180° towards the second half of dial sinkers (4'), and wherein the second half of dial sinkers (4') take the knitted loops of the retained edge off the transferring means (5,6, 51,61) and then transfer the knitted loops of the retained edge to the second half-circle of needles.

3. A method of claim 1, wherein by retracting the first half of dial sinkers (4) with the knitted loops of the retained edge inward, the knitted loops are taken off and detachably attached to the loop retaining ends of the transferring means (5,6,51,61 ), and after overturning the transferring means by 180 degrees, the second half of dial sinkers (4') is extended and the knitted loops of the retained edge are taken off the loop retaining ends of the transferring means (5,6,51,61) and the knitted loops of the retained edge are subsequently transferred to a position over the respective ones of the second half-circle of needles, which lift upward and engage the knitted loops of the retained edge.

4. A method of claim 1, wherein the courses knitted by the first half of dial sinkers (4) correspond to a heel part of the knitted product.

5. A method of claim 1, wherein the knitted product is a sock.

* * * * *